US005540365A

United States Patent [19]

LaMair

[11] Patent Number: 5,540,365

[45] Date of Patent: Jul. 30, 1996

[54] STRAP SUSPENSION SYSTEM FOR INFANT CAR SEAT

[76] Inventor: Michael E. LaMair, 518 Franklin St., Denver, Colo. 80218

[21] Appl. No.: 235,353

[22] Filed: Apr. 29, 1994

[51] Int. Cl.[6] ..... A61G 1/00; A61G 5/00

[52] U.S. Cl. ..... 224/158; 224/159; 224/257; 224/258; 224/264; 224/269; 224/907; 224/585; 224/608; 224/611; 297/250.1; 297/276; 297/277; 297/256.16

[58] Field of Search ..... 224/158–161, 224/202, 254, 257, 258, 264, 268, 269, 907; 297/4, 250.1, 273, 276, 256.16, 183; 294/140, 151, 154, 155, 157

[56] References Cited

U.S. PATENT DOCUMENTS 755,554 10/1902 Turnbull .
2,554,340 5/1951 Maxwell .
2,628,358 11/1949 Neils ..... 2/69.5
2,846,699 5/1956 Watson ..... 5/98
4,324,430 4/1980 Dimas, Jr. et al. ..... 297/250
4,729,600 3/1988 Single, II et al. ..... 297/250
5,267,680 12/1993 Torok ..... 224/158

*Primary Examiner*—Henry J. Recla
*Assistant Examiner*—Timothy L. Maust
*Attorney, Agent, or Firm*—John E. Reilly

[57] ABSTRACT

A shoulder strap suspension system has been devised for infant car seats of the rigid or molded shell type, the suspension system being made up of a shoulder strap and an undercarriage which releasably surrounds the end and side walls of the car seat and serves as an anchor or support for connecting ends of the shoulder strap either in a two point or a three point suspension, and contoured hip pads are provided on either or both sides of the car seat.

15 Claims, 2 Drawing Sheets

STRAP SUSPENSION SYSTEM FOR INFANT CAR SEAT

BACKGROUND AND FIELD OF THE INVENTION

This invention relates to infant carriers, and more particularly relates to a novel and improved suspension system for infant carriers and particularly infant car seats which will enable suspension of the car seat from one's shoulder in a reliable and efficient manner.

Infant car seats are typically comprised of a molded body or shell and one or more handles or hand grips to enable the seat to be picked up and carried by an adult either with one or both hands. When the car seat and its occupant are carried over any distances it can become very unwieldy and deterring for the adult. Shoulder straps have been devised for various types of infant carriers to enable suspension of the carrier and infant from one or both shoulders of the adult and, for example, reference is made to U.S. Pat. No. 4,324,430 to Dimas Jr., et al., U.S. Pat. No. 755,554 to Turnbull, U.S. Pat. No. 2,628,358 to Neils and U.S. Pat. No. 4,487,346 to Fischer. Suspension straps have also been used with more rigid infant carriers and, for example, reference is made to U.S. Pat. No. 2,846,699 to Watson but requires a special design and construction of the carrier to make it usable with a shoulder strap.

It is therefore proposed to provide for a novel and improved shoulder suspension system for infant carriers of the rigid shell type and wherein the suspension system is capable of achieving balanced suspension of the carrier from the shoulder and is conformable for use with different sizes and shapes of carriers particularly of the car seat variety.

SUMMARY OF THE INVENTION

It is therefore an object of the present invention to provide for a novel and improved shoulder suspension system for infant carriers.

It is another object of the present invention to provide for a novel and improved shoulder suspension system for rigid shell type infant carriers and particularly of the car seat variety in which the shoulder suspension system will achieve balanced suspension of the carrier when suspended from one shoulder of an adult.

It is a further object of the present invention to provide for a novel and improved shoulder suspension system for infant carriers of the rigid shell type and which system is more comfortable and less tiring for the adult in carrying an infant over extended distances.

It is an additional object of the present invention to provide for a novel and improved shoulder suspension system for infant car seats which is conformable for use with different sizes and types of car seats, can be easily attached to or removed from the car seat, and does not interfere with existing handles or hand grips on the car seat.

In accordance with the present invention, a shoulder suspension system has been devised for use with an infant carrier of the type having a bottom panel, opposite front and rear end walls and opposite side walls, the shoulder suspension system comprising a shoulder strap including a shoulder-supporting portion and opposite first and second connecting ends, first attaching means for connecting the first connecting end adjacent to the rear wall intermediately between the side walls, and second attaching means for connecting the second connecting end adjacent to the front wall relatively near one of the side walls and away from the other of said side walls.

In the preferred form, the strap extends somewhat diagonally with respect to the longitudinal axis of the car seat so that the second attaching means is located at a point offset from the axis and toward the body of the adult when being carried. In order to facilitate suspension of the shoulder strap from different sizes and types of car seats, the second attaching means includes a suspension member extending between opposite side walls across the upper open end of the carrier and in proximity to the front wall, and a pair of attaching rings are affixed to the suspension member relatively near opposite side walls so that the second connecting end of the strap may be attached to either attaching ring depending upon whether the carrier is suspended from the left or right shoulder of the adult. In addition, flexible support means is provided in surrounding relation to the carrier shell so that the suspension member may be attached at opposite ends to the support means and extend over the side walls across the upper open front end of the carrier for convenient attachment of the second connecting end of the shoulder strap.

In a modified form of the invention, second and third spaced connecting ends are provided at the front end of the shoulder strap for attachment either to the spaced connecting rings on the suspension member or directly to the flexible support, and a hip pad may be disposed on one or both sides of the support means to afford greater comfort for the adult when the infant carrier is placed against the hip.

The above and other objects, advantages and features of the present invention will become more readily appreciated and understood from a consideration of the following detailed description of preferred and modified forms of the invention when taken together with the accompanying drawings, in which:

DETAILED DESCRIPTION OF THE PREFERRED EMBODIMENT(S)

Figure 1:
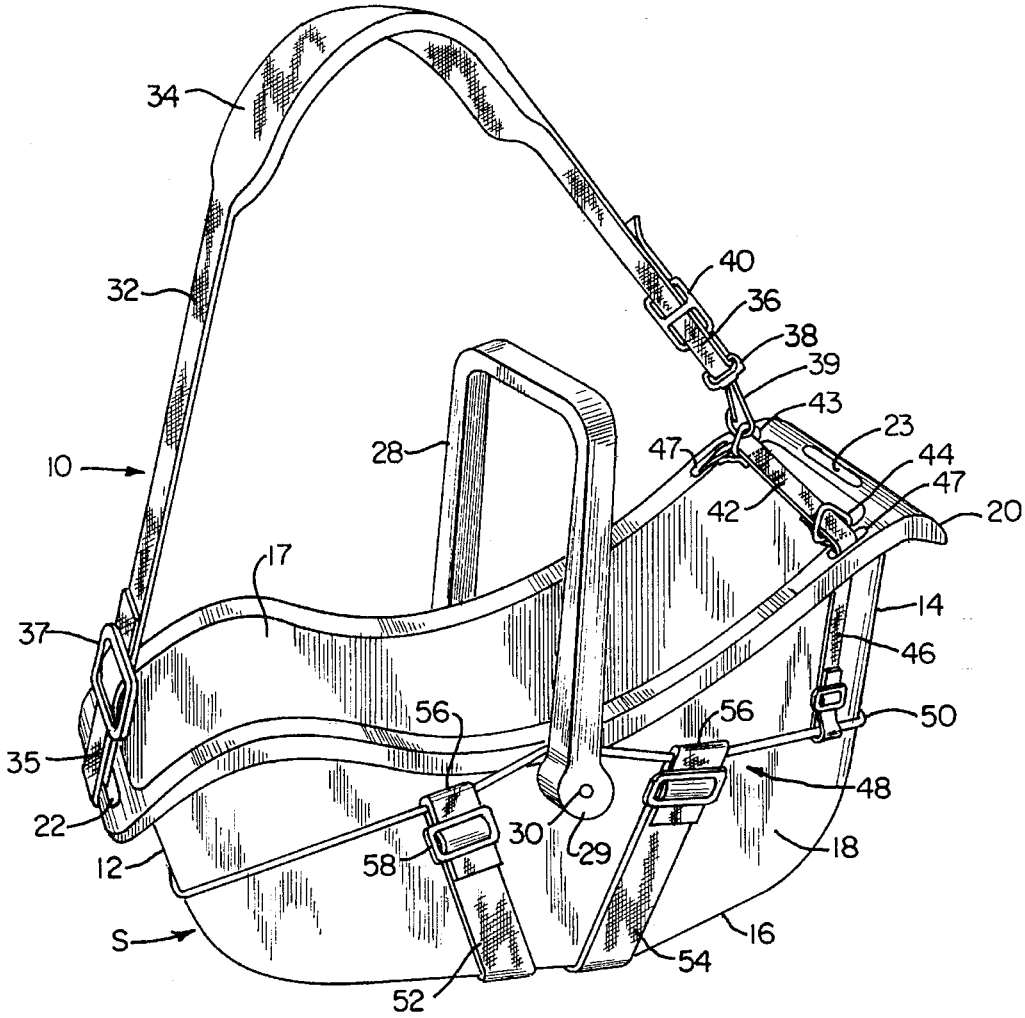
FIG. 1 is a perspective view of a preferred form of invention mounted on a standard car seat.
Figure 2:
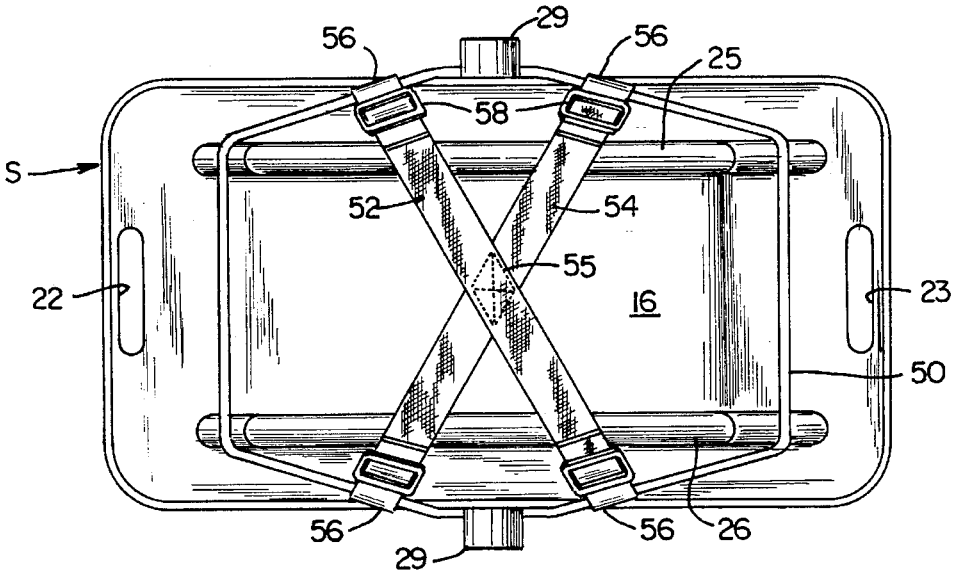
FIG. 2 is a bottom plan view of the preferred form of invention shown in FIG. 1.
Figure 3:
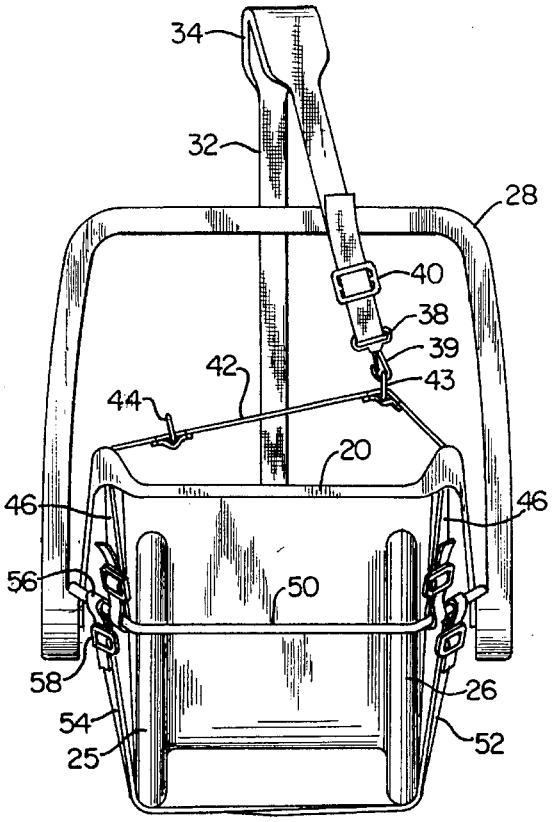
FIG. 3 is an end view in elevation of the preferred form of the suspension system shown in FIG. 1.

Referring in more detail to the drawings, there is shown by way of illustrative example in FIGS. 1 to 4 a preferred form of shoulder suspension system 10 installed on a conventional car seat S, and it is to be understood that the car seat S is merely illustrative of various sizes and shapes of infant carriers of the rigid shell type with which the present invention may be utilized. The standard car seat S is broadly comprised of a rear wall 12, front wall 14, bottom panel 16, opposite side walls 17 and 18, and an upper surrounding edge or rim 20. Typically, elongated slots 22 and 23 are formed in opposite end walls 12 and 14 which define hand grips for the purpose of grasping opposite ends of the car seat by an adult in placing or removing the car seat S onto or from the seat of a vehicle. A pair or ribs 25 and 26 extend in spaced parallel relation to one another along the exterior of the bottom panel 16 and serve as base supports for resting the car seat S on a vehicle seat or other surface. In addition, a handle 28 is in the form of a bracket of inverted, generally U-shaped configuration which terminates in opposite free ends 29 and are pivotally connected as at 30 to the mid section of the side walls 17 and 18 for lifting and carrying the seat with one hand.

In the preferred form of invention, the shoulder system 10 comprises an elongated strap 32 which may be composed of suitable webbing, fabric, leather or like material and has a widened shoulder-supporting portion 34 which may or may not be padded and opposite connecting ends 35 and 36. The connecting end 35 has a standard buckle 37 which is of a type such that the free end 35 with the strap may be looped through the slot 22 in the rim 20 and passed through the buckle 37 and tightened or hinged in a conventional manner. The opposite connecting end 36 similarly has its free end passing through a slot 38 in a swivel hook 39 and adjusted to the desired length by a standard buckle 40 of the same type as the buckle 37.

It has been found that the car seat is best balanced from the shoulder by connecting the second or front connecting end 36 in laterally offset relation to the longitudinal center line or axis of the car seat and at a point relatively near the side wall 17 which is nearest to the body so that the strap extends somewhat diagonally from the center of the rear wall toward an inside corner of the car seat between the side wall 17 and front end wall 14. To this end, an offset attachment point is provided by a suspension member in the form of a transversely extending strap 42 having a connecting ring 43 sewn into or otherwise attached to the suspension member adjacent to the side wall 17. A second connecting ring 44 is sewn into the strap 42 at a point adjacent to the inner side wall 18 for use in the event that the car seat is carried on the opposite shoulder and the side wall 18 should become the outer side wall against the body. The connecting rings 43 and 44 are of standard construction and may for example be conventional D-rings or triangular rings which will afford sufficient clearance for the swivel hook 39 to be snapped onto either ring. The suspension strap 42 extends transversely across the upper open forward end of the car seat in spaced parallel relation to the front end wall 14 and has opposite connecting ends 46 passing through slots 47 in the rim 20 and then downwardly for adjustable connection to flexible support means in the form of a flexible undercarriage 48.

The undercarriage 48 is releasably disposed in outer surrounding relation to at least opposite end walls and side walls of the car seat and includes a peripherally extending cord or band 50 which passes around the opposite end walls 12 and 14 and side walls 17 and 18 and over the socket end portions 29 of the handle 28. The cord 50 is supported by a pair of straps 52 and 54 which extend in crisscross fashion beneath the bottom panel 16, each of the straps 52 and 54 having adjustable connecting ends 56 which are adjustably secured to the cord 50 by standard buckles 58 of the same type as the buckles 37 and 40 hereinbefore described. Thus the connecting ends 56 are looped around the cord 50, passed through the buckles 58 and then tightened to place the desired tension on the suspension strap 42. Preferably, the cord 50 is of flexible but nonelastic material so as to firmly support the suspension strap 42 in position. The straps 52 and 54 may be made up of the same type of webbing material as the shoulder strap 32 and preferably the straps 52 and 54 are stitched together as shown at 55 at their intersection with one another so as not to unduly shift once connected to the cord 50. It will be apparent that other flexible supporting members may be used in place of the straps and for example, a netting or mesh material may be used as the flexible support for the cord 50; or if the car seat itself is specially designed with supporting ribs or notches at appropriate points along the end walls 12 and 14 and side walls 17 and 18 to support the cord 50 without the use of support straps 52 and 54 or netting as described.

Figure 4:
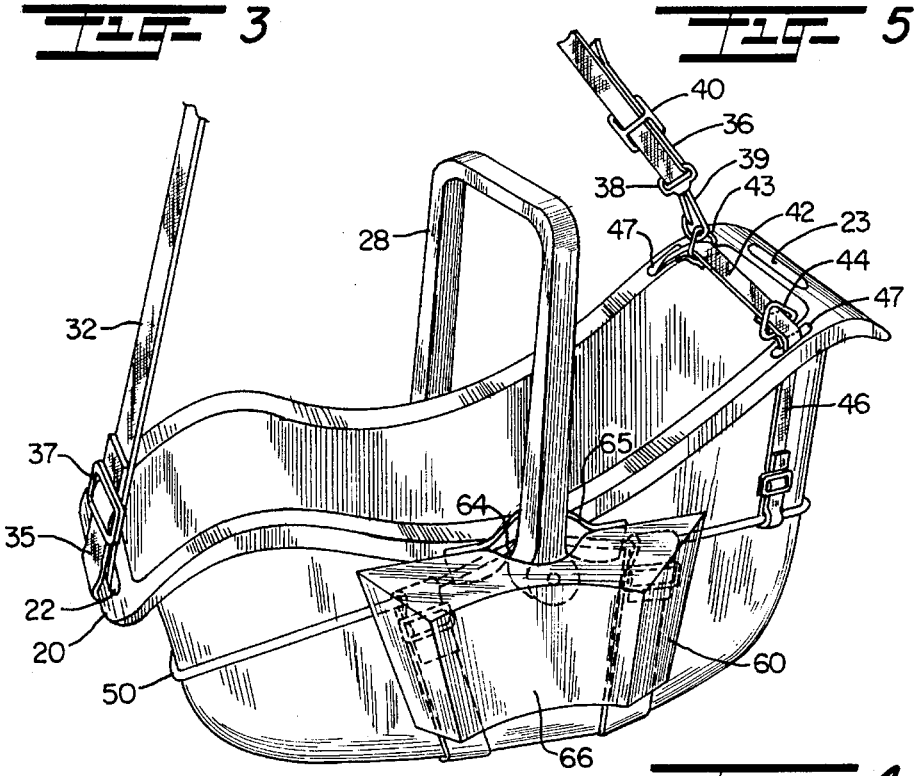
FIG. 4 is a perspective view of the preferred form of invention illustrating a hip pad mounted on one side of the suspension system and car seat.

As an additional feature of the present invention, as shown in FIG. 4, a contoured hip pad 60 may form a part of the undercarriage, the pad 60 being composed of a suitable padding or cushioning material, such as, a plastic, rubber or rubber-like material with suitable openings or passages at opposite sides of the pad to receive the connecting ends 56 of the support straps. In addition, the pad is recessed as at 64 to fit over the socket 29 of the handle 28 and may have an additional connecting strap 65 to secure the hip pad to the handle 28. An outer exposed surface 66 of the hip pad is generally concave in a direction lengthwise of the pad and of the car seat so as to conform to the hip region of the person carrying the seat, since the car seat will ride against the hip when suspended from the shoulder. A hip pad 60 as described may be placed on both sidles of the undercarriage for use when the car seat is to be suspended from the opposite shoulder.

DETAILED DESCRIPTION OF MODIFIED FORM OF INVENTION

Figure 5:
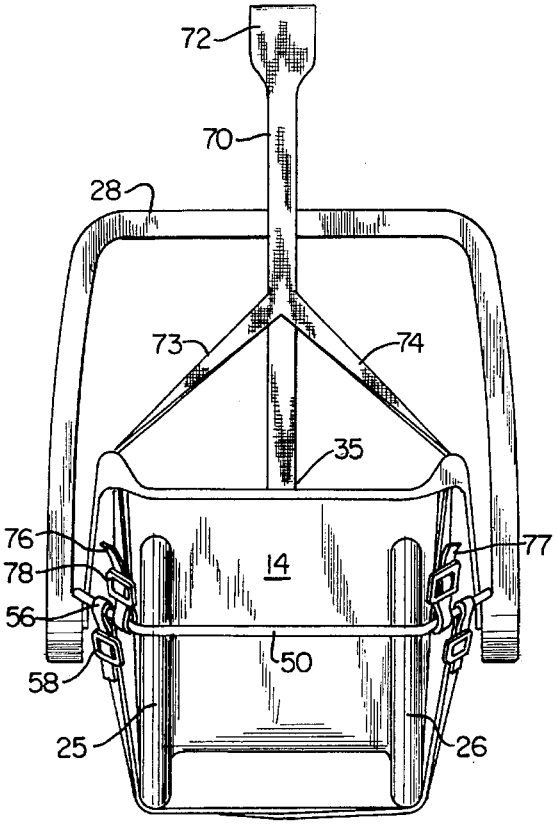
FIG. 5 is an end view of a modified form of invention shown mounted on a standard car seat.

A modified form of suspension strap 70 is illustrated in FIG. 5 for use in combination with an undercarriage 48 corresponding to that described in FIG. 1 to 4, and other like parts to those of the preferred form are correspondingly enumerated. In the modified form, a shoulder suspension strap 70 includes a first connecting end 35 corresponding to that of the preferred form and therefore is not shown in detail. Also, the strap 70 includes a widened shoulder-support portion 72 and a pair of spaced connecting end portions 73 and 74 which diverge away from the forward end of the strap 70 and pass through slots 47 in the rim 20 to terminate in free ends 76 and 77, respectively, which are adjustably connected to the cord 50 of the undercarriage 48. Each of the free ends 76 and 77 is looped over the cord 50 and adjustably tightened by means of a standard buckle 78. In this manner, a three point suspension is formed by the connecting ends 35, 73 and 74. It will be evident that, in the absence of the slot 47, the connecting end portions 73 and 74 may be passed directly over the upper side edges or rim of the car seat and connected to the cord 50; or, in the alternative, the connecting end portions 73 and 74 may be adjustably connected to the slots 47 in the rim 20.

From the foregoing, preferred and modified forms of a strap suspension system have been described for the purpose of achieving balanced suspension of a car seat or other infant carrier, particularly of the rigid shell type, from the shoulder. The simplified construction of the undercarriage lends itself well to use on different sizes and shapes of infant carriers and, as earlier noted, may undergo suitable changes in material construction and arrangement while accomplishing the same end. It has been found that best balance of the carseat is achieved by attaching the front connecting end 36 nearest to the sidewall against the body, and the shoulder supporting strap 32 may be suspended from either shoulder. In addition, although the hip pad 60 as illustrated in FIG. 4 is disposed on the sidewall nearest to the body with the front connecting end 36 attached to the fastener 43 away from the body, typically the front connecting end 36 would be attached to the fastener 44 nearest to the hip pad 60 which rides against the body. In other words, in the form shown in FIG. 4, the positioning of the connecting end 36 would be intended more for suspension on the right side and another hip pad would be mounted on that sidewall nearest to the body of the person carrying the seat. Further, if desired, while an endless cord 50 has been illustrated, the cord may be split and provided with connecting ends to permit adjustment in the effective length of the cord to conform to the size of the carrier.

It is therefore to be understood while preferred and modified forms have been herein set forth and described, the above and other modifications and other changes may be made in the construction and arrangement of parts without departing from the spirit or the scope of the present invention as defined by the appended claims and reasonable equivalents thereof.

I claim:

1. In an infant carrier having an elongated bottom panel, opposite front and rear end walls and elongated opposite side walls, the combination therewith comprising:

a unitary shoulder strap including a shoulder-supporting portion and first and second connecting end portions at opposite ends of said shoulder-supporting portion; and first attachment means for connecting said first connecting end portion in fixed relation to said rear wall intermediately between said side walls when said infant carrier is suspended from a person's shoulder, and second attachment means in proximity to said front end wall and one of said side walls for connecting said second connecting end portion in a non-movable positive relative to said front end wall near one of said side and away from another of said side walls when said infant carrier is suspended from a person's shoulder whereby said shoulder strap extends angularly between said front and rear end walls a diverges in a lateral direction away from a longitudinal axis through said carrier in its extension from said first attachment means to said second attachment means.

2. In an infant carrier according to claim 1, said second attachment means including a suspension member extending between said opposite side walls and in proximity to said front wall.

3. In an infant carrier according to claim 2, wherein a pair of second attachments means are attached at opposite ends of said suspension member for interchangeable attachment of said second connecting end portion of said shoulder strap to a selected one of said second attachment means.

4. In an infant carrier according to claim 1, including a flexible undercarriage, and means for releasably securing said flexible undercarriage in surrounding relation to said bottom panel, said front and rear opposite end walls and said opposite side walls.

5. In an infant carrier according to claim 4, said undercarriage including a cord member extending peripherally around said end walls and side walls, and said second means including a suspension member connected to said cord member and extending over said opposite side walls.

6. In an infant carrier according to claim 5, said undercarriage including flexible support members extending beneath said bottom wall and having opposite ends connected to said cord member.

7. In an infant carrier according to claim 1, including a flexible undercarriage in surrounding relation to said opposite end and side walls, and a hip pad disposed on an exterior surface of at least one of said opposite side walls.

8. A shoulder suspension system for a car seat in the form of a molded or rigid shell wherein said car seat has a bottom panel, opposite front and rear end walls and opposite side walls, said system comprising:

a shoulder suspension strap including a shoulder-supporting portion and first and second connecting end portions;

first means for connecting said first connecting end portion adjacent to said rear end wall intermediately between said side walls;

flexible support means including a cord member adapted to extend peripherally around said front and rear end walls and said side walls, and second means for connecting said second connecting end portion adjacent to said front end wall relatively near one of said side walls and away from another of said side walls; and said second means including a suspension member connected to extend from said cord member across said side walls having at least one attachment member thereon for releasable connection of said second connecting end portion thereto.

9. A shoulder suspension system according to claim 8, said attachment member being in laterally spaced relation to a center line through said car seat.

10. A shoulder suspension system according to claim 8, said flexible support means including flexible straps adapted to extend beneath a bottom wall of said car seat and having opposite ends connected to said cord member.

11. A shoulder suspension system according to claim 8, said flexible support means including a hip pad disposed externally of at least one of said opposite side walls of said car seat.

12. A shoulder suspension system for a car seat in the form of a molded or rigid shell wherein said car seat has a bottom panel, opposite front and rear end walls and opposite side walls, said system comprising:

a shoulder strap including a shoulder-supporting portion and connecting end portions at opposite ends of said shoulder strap including first, second and third connecting end portions;

flexible support means in surrounding relation to said car seat including a cord member adapted to extend peripherally around said front and rear end walls and said side walls; and first attaching means for connecting said first connecting end portion to said rear end wall intermediately between said side walls; and said second and third connecting end portions diverging away from said shoulder strap over said opposite side walls for connection to said cord member on said opposite side walls of said car seat.

13. A shoulder suspension system according to claim 12, said second and third connecting end portions adapted to extend through slots in upper edges of said opposite side walls and including means for adjustably connecting said second and third connecting end portions to said cord member.

14. A shoulder-suspension system for a car seat according to claim 12, said flexible support means including at least one flexible strap adapted to extend beneath said bottom panel and having opposite ends connected to said cord member.

15. In an infant carrier having a bottom panel, opposite front and rear end walls and opposite side walls, the combination therewith comprising:

a unitary shoulder strap including a shoulder-supporting portion and first and second connecting end portions at opposite ends of said shoulder-supporting portion;

first means for connecting said first connecting end portion in fixed relation to said rear wall intermediately between said side walls, and second means for connecting said second connecting end portion in fixed relation to said front wall relatively near one side wall and away from another of said side walls wherein said shoulder strap extends angularly between said front and rear end walls; and a flexible undercarriage in surrounding relation to said opposite end and side walls, and said second means including a flexible suspension member extending over said side walls and having opposite ends secured to said flexible undercarriage.

* * * * *

UNITED STATES PATENT AND TRADEMARK OFFICE

CERTIFICATE OF CORRECTION

PATENT NO. : 5,540,365

DATED : 30 July, 1996

INVENTOR(S) : LaMair, M. E.

It is certified that error appears in the above-identified patent and that said Letters Patent is hereby corrected as shown below:

IN THE CLAIMS Column 5,

| | | |
|---|---|---|
| Claim 1 | Line 33 | after "side", insert -- walls -- |
| | Line 37 | cancel "a" (First Occurrence) and substitute -- and -- |

Signed and Sealed this

Fifteenth Day of October, 1996

Bruce Lehman

*Attest:*

BRUCE LEHMAN

*Attesting Officer*

*Commissioner of Patents and Trademarks*